United States Patent [19]

Takano et al.

[11] 4,408,862

[45] Oct. 11, 1983

[54] DEVELOPING APPARATUS FOR ELECTROSTATIC COPYING MACHINE

[75] Inventors: Toshimasa Takano, Sagamihara; Masahiro Hosoya; Reiji Murakami, both of Yokohama, all of Japan

[73] Assignee: Tokyo Shibaura Denki Kabushiki Kaisha, Kawasaki, Japan

[21] Appl. No.: 223,928

[22] Filed: Jan. 9, 1981

[30] Foreign Application Priority Data

Jan. 18, 1980 [JP] Japan ..... 55/4320
Jan. 18, 1980 [JP] Japan ..... 55/4321
Jan. 18, 1980 [JP] Japan ..... 55/4325

[51] Int. Cl.[3] ..... G03G 15/08

[52] U.S. Cl. ..... 355/3 DD; 430/123; 118/656

[58] Field of Search ..... 355/3 DD, 651, 653, 355/656; 430/123

[56] References Cited

U.S. PATENT DOCUMENTS 3,103,445 9/1963 Bogdanoff et al. ..... 117/17.5
3,152,012 10/1964 Schaffert ..... 118/637
3,251,706 5/1966 Walkup ..... 355/3 DD X
3,357,402 12/1967 Bhagat ..... 118/637
3,638,613 2/1972 Klavsons et al. ..... 118/656
3,664,857 5/1972 Miller ..... 430/123
3,682,678 8/1972 Moradzadeh et al. .
3,691,993 9/1972 Krause et al. .
3,692,402 9/1972 Solarek ..... 355/3 DD
4,034,709 7/1977 Fraser et al. ..... 355/3 DD X
4,087,279 5/1978 Sandner .
4,240,740 12/1980 Young ..... 355/3 DD

FOREIGN PATENT DOCUMENTS 53-26135 3/1978 Japan ..... 355/3 DD

OTHER PUBLICATIONS

*IBM Technical Disclosure Bulletin;* vol. 12, No. 8, Jan. 1970, pp. 1216–1217; *Padding Development of Electrostatic Images,* by Bettiga et al.

*Primary Examiner*—G. Z. Rubinson
*Assistant Examiner*—Keith E. George
*Attorney, Agent, or Firm*—Schuyler, Banner, Birch, McKie & Beckett

[57] ABSTRACT

A developing apparatus for developing an electrostatic image on an electrostatic image bearing member. The apparatus is provided with a container for storing toner which is a single component developer. A developing brush roller having fur on its peripheral surface transports the toner from the container and applies it to the electrostatic latent image. The developing brush roller is constructed of a core formed with elastic material and a fur formed on the peripheral surface of the core which contacts the surface of the electrostatic image bearing member.

9 Claims, 16 Drawing Figures

FIG. 5
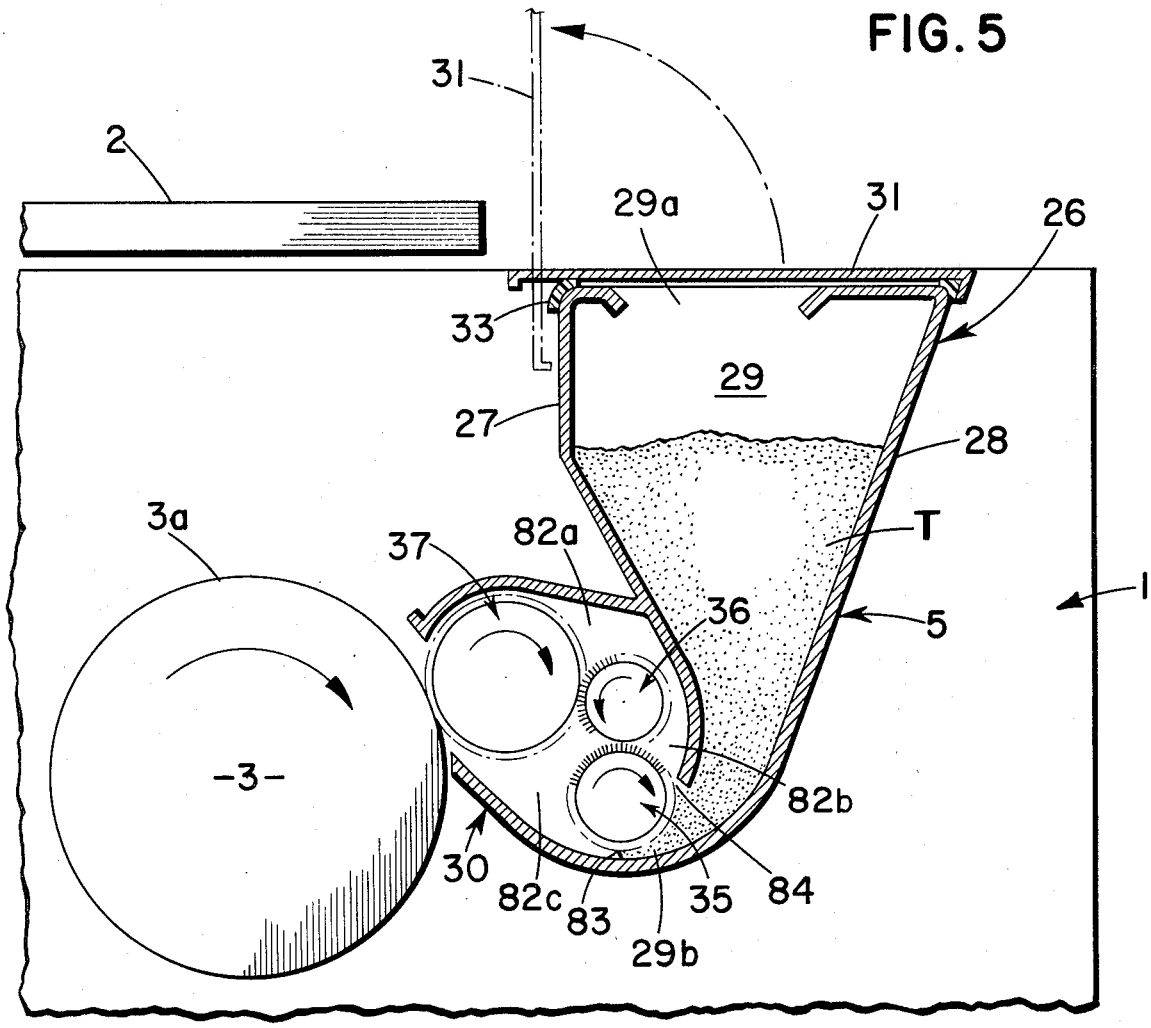
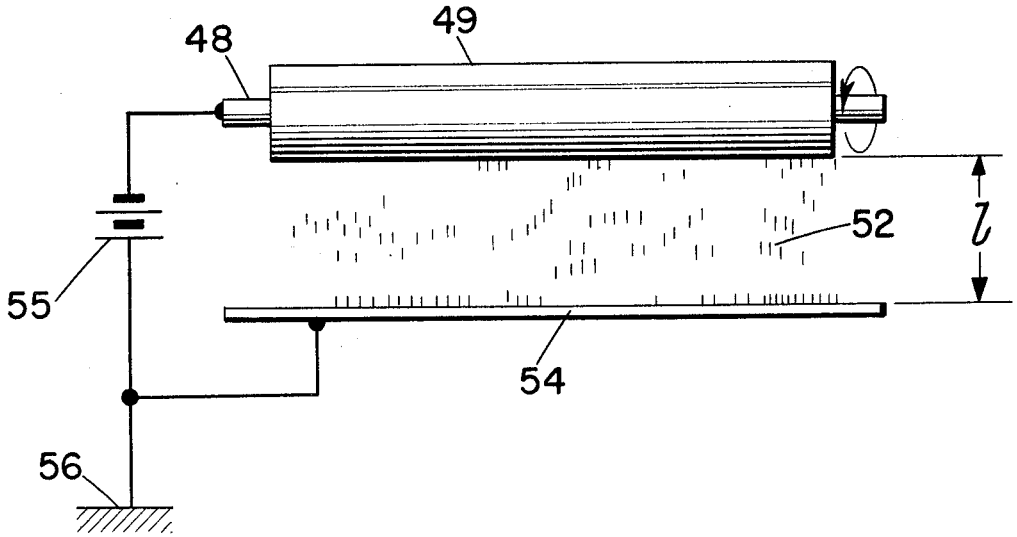
FIG. 10

FIG. 6
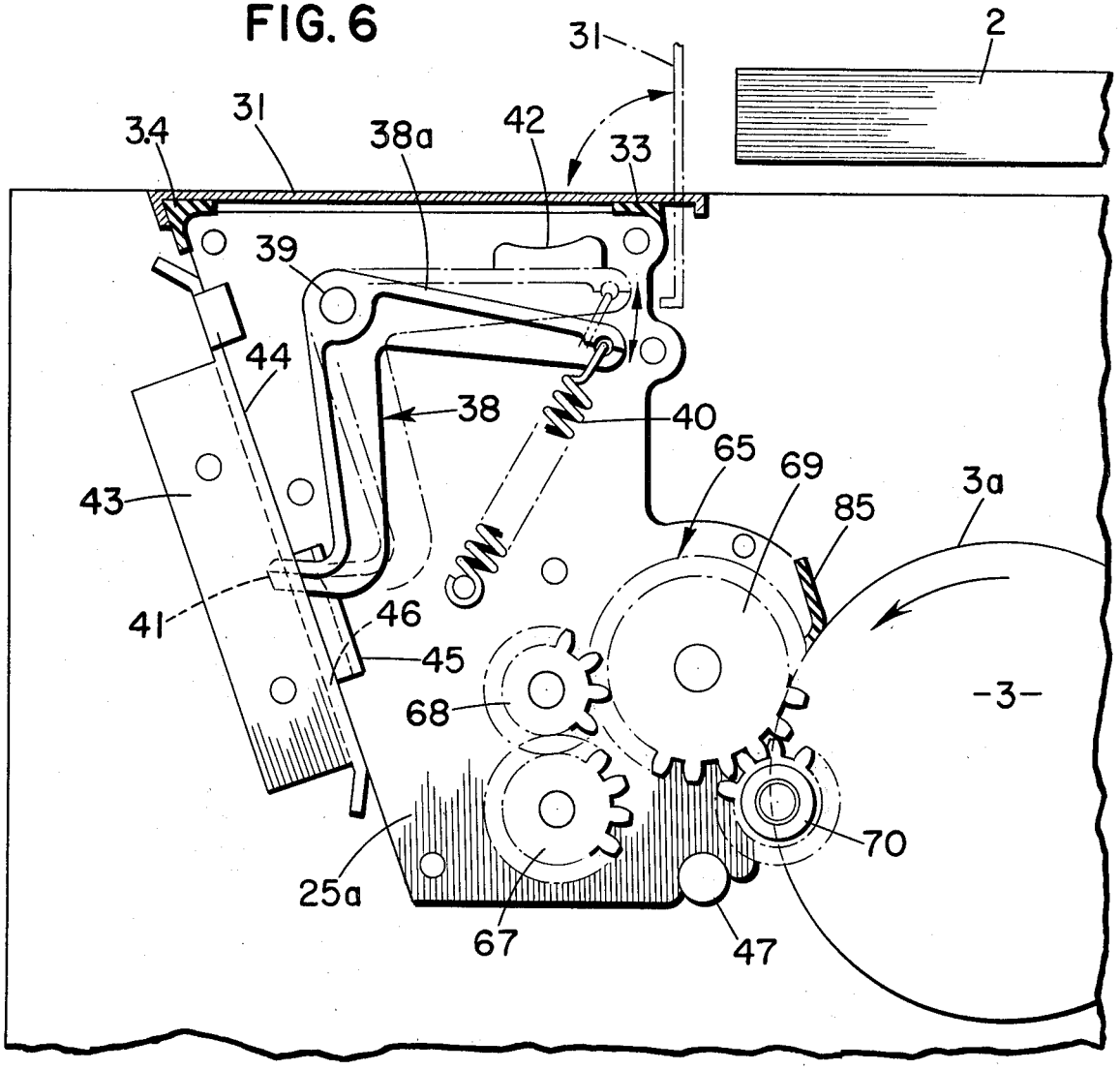
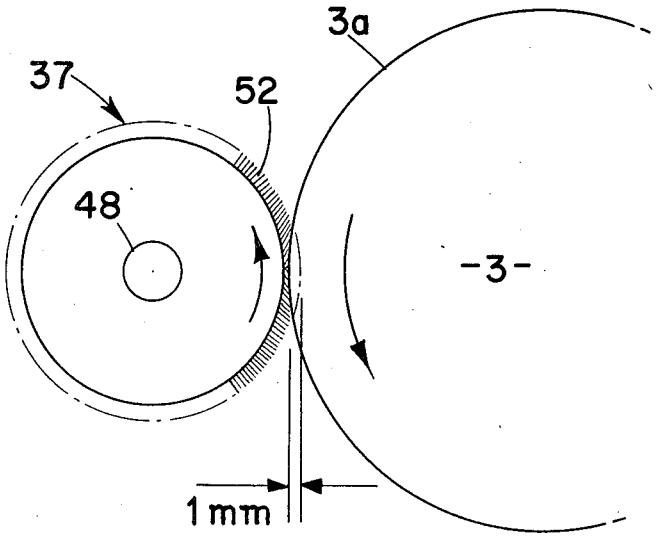
FIG. 11
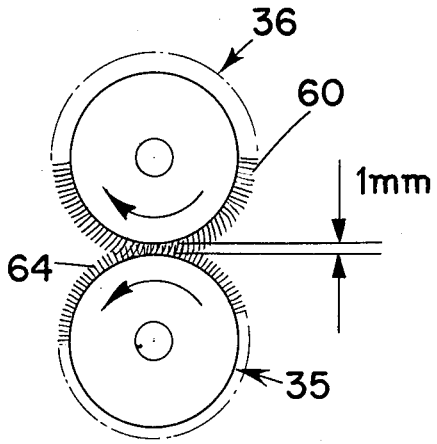
FIG. 12

FIG. 13
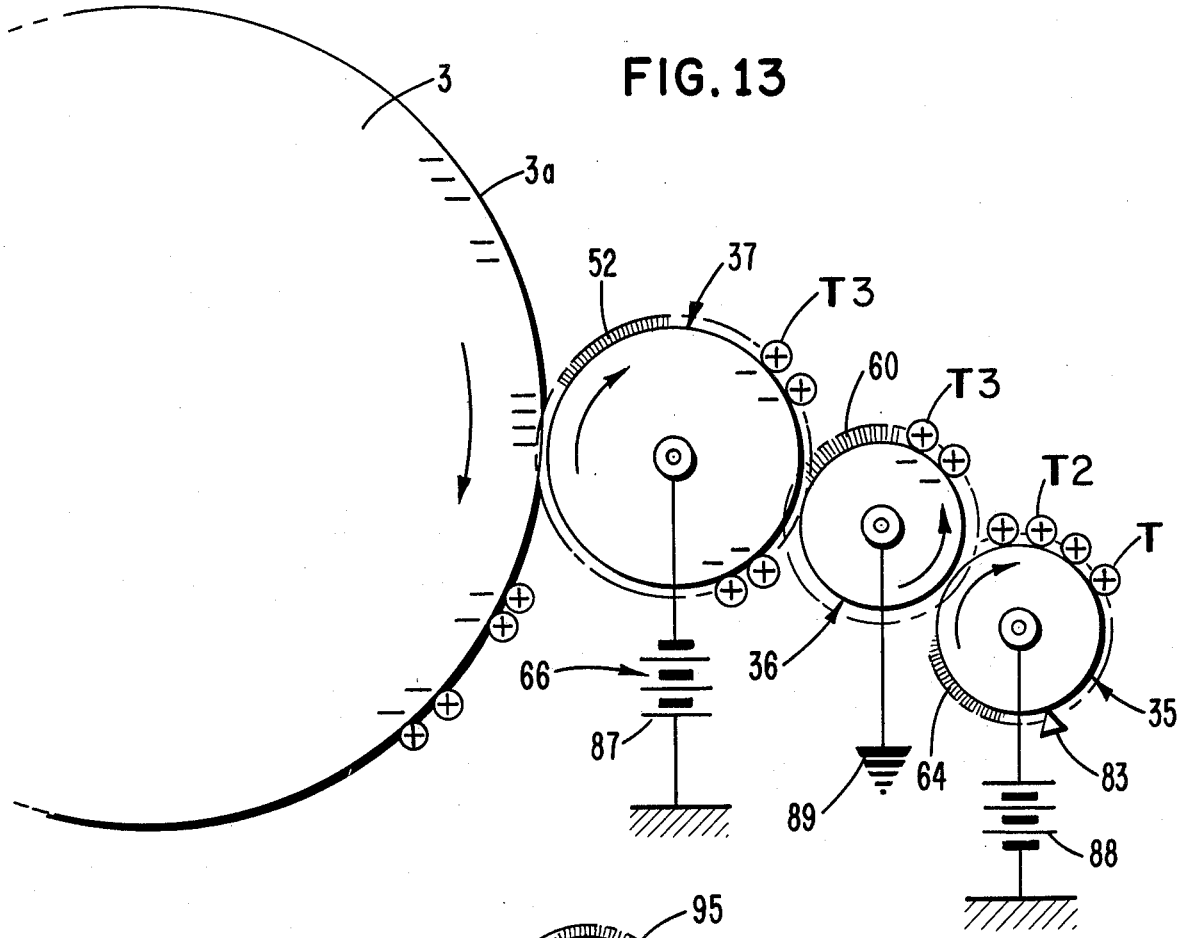
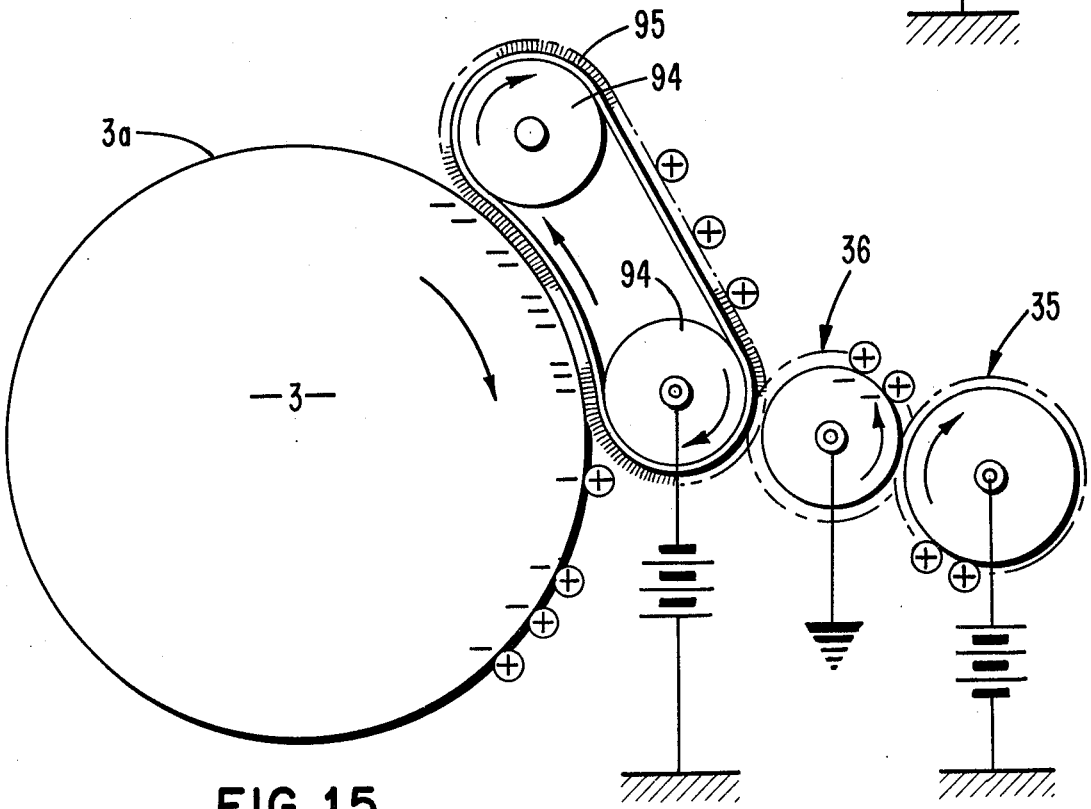
FIG. 15

FIG. 14
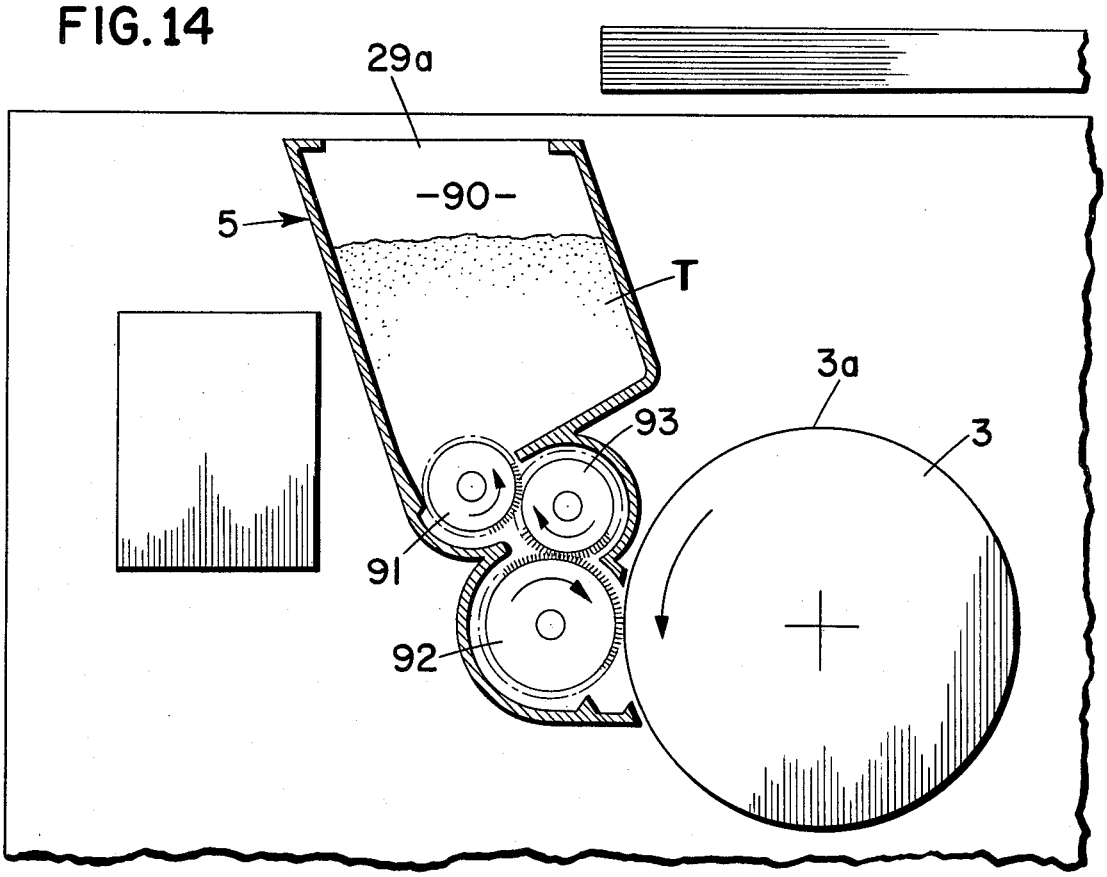
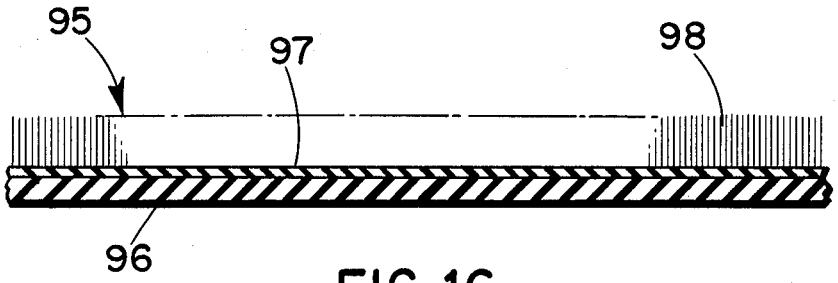
FIG. 16

DEVELOPING APPARATUS FOR ELECTROSTATIC COPYING MACHINE

BACKGROUND OF THE INVENTION

This invention relates to a developing apparatus for an electrostatic copying machine, and more particularly, to a dry or powder-type developing apparatus employing a single component developer.

In general, in electrostatic copying machines, a photosensitive member is charged. The photosensitive member then is exposed to a light image corresponding to the original subject matter to form a latent electrostatic image on the photosensitive member. In accordance with the electric potential of the latent electrostatic image, the developing apparatus causes an electrically charged developer to adhere to the electrostatic latent image on the photosensitive member. The developed image is then transferred to and fixed on paper. In this manner, copies are obtained by a typical electrostatic copying machine.

There are various kinds of developing apparatus used in electrostatic copying machines. Among them, an industrialized one includes a magnetic brush formed by coating a magnetic roller with developer consisting of two components which are toner and carrier particles. This magnetic brush contacts the photosensitive member on which an electrostatic latent image has been formed to cause the toner particles to adhere to the above-mentioned latent image, and thus a visible image is developed. Other than this, a developing apparatus recently has been developed having a magnetic brush formed by coating a magnetic roller with a single component developer composed only of toner particles. The single component developer used in this system has toner particles containing an iron powder which is attracted magnetically.

The magnetic roller used in the above developing apparatus is expensive, and it is difficult to minimize the manufacturing cost because the N and S magnetic poles on the magnetic roller must be formed alternately over the peripheral surface of a magnetizable cylindrical member. In addition, the gap between the magnetic roller and the photosensitive member often must have an accuracy of 0.1 mm. Consequently, the developing apparatus must be manufactured to satisfy this accuracy requirement, resulting in increased complexity of the mechanism. In particular, the accuracy requirement is severe in the case of a developing apparatus using a single component toner. Also, in a developer which includes a carrier, the carrier itself has a certain life and and the deteriorated carrier has to be replaced with new carrier periodically after 10,000 to 20,000 copies are made. This requires much time and labor.

SUMMARY OF THE INVENTION

An object of this invention is to provide an inexpensive developing apparatus at a low manufacturing cost without the use of a magnetic roller.

Another object of the invention is to provide a developing apparatus which does not have a strict accuracy requirement for the distance between the electrostatic latent image bearing member and the developing roller.

A further object of the invention is to provide a developing apparatus which uses a single component toner thereby requiring no replacement of the carrier.

The present invention is directed to a single component developer type developing apparatus for developing an electrostatic latent image on a photosensitive drum or other image bearing member. The developing apparatus includes a container filled with toner which is a single component developer. The apparatus is also provided with a developing roller which receives toner from the container and applies it to the electrostatic latent image. This developing roller consists of a core member made of elastic material. Fur is formed on the peripheral surface of this core member in such a manner as to make contact with the electrostatic latent image bearing member.

BRIEF DESCRIPTION OF THE DRAWINGS

FIG. 5 is a sectional view showing the installation of the developing apparatus in the main body;

FIG. 6 is a side view showing the drive mechanism of the developing apparatus;

FIG. 10 is an explanatory view showing the method of forming the fur of the developing roller;

FIG. 11 is a side view showing the condition where the developing roller is arranged to make contact with the photo sensitive drum;

FIG. 12 is a side view showing the arrangement of the first and second brush rollers;

FIG. 13 is an explanatory view showing the supply of toner to the photosensitive member;

FIG. 14 is a sectional drawing showing an example of another embodiment of the developing apparatus of this invention;

FIG. 15 is an explanatory view showing another embodiment of the present invention; and FIG. 16 is a partial sectional view of the developing belt of FIG. 15.

DETAILED DESCRIPTION OF THE PREFERRED EMBODIMENT

Figure 1:
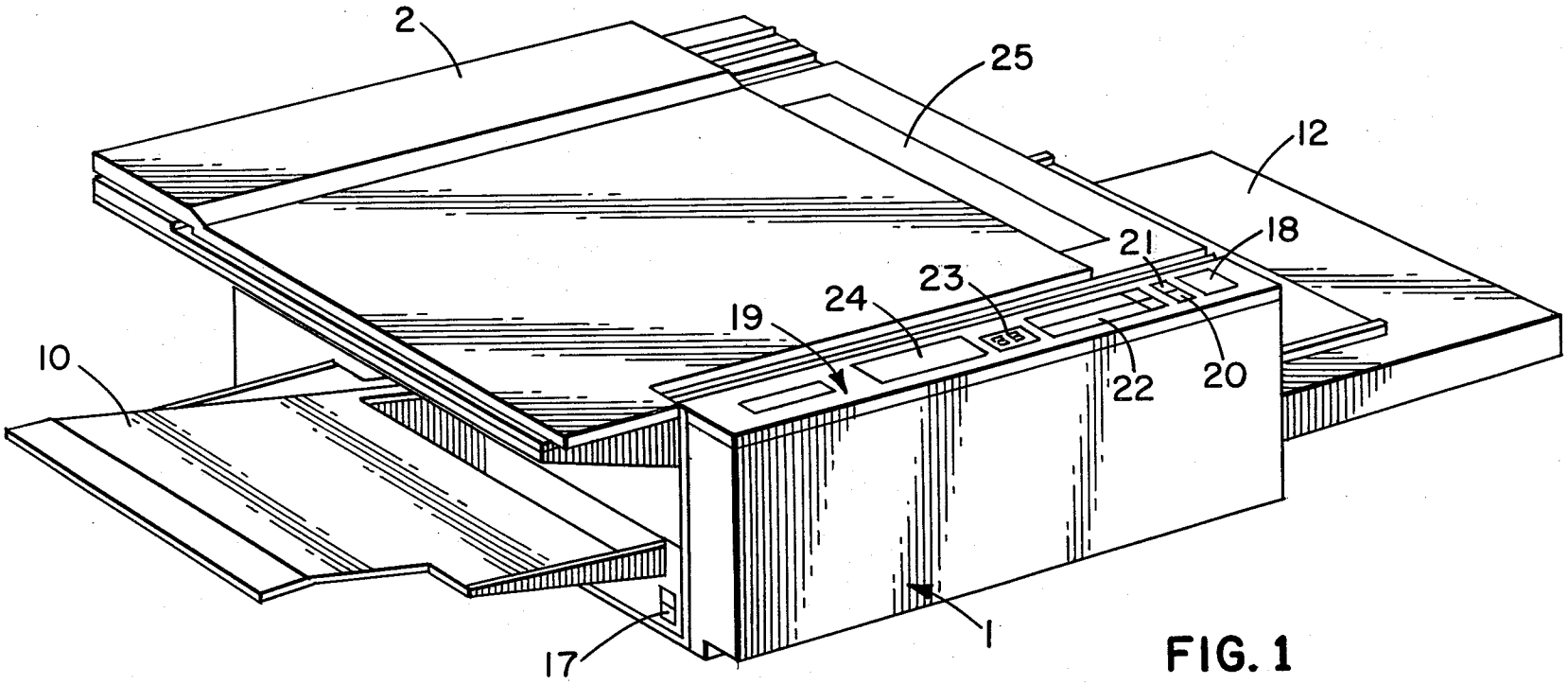
FIG. 1 is a perspective view of the electrostatic copying machine having a developing apparatus according to the present invention.
Figure 2:
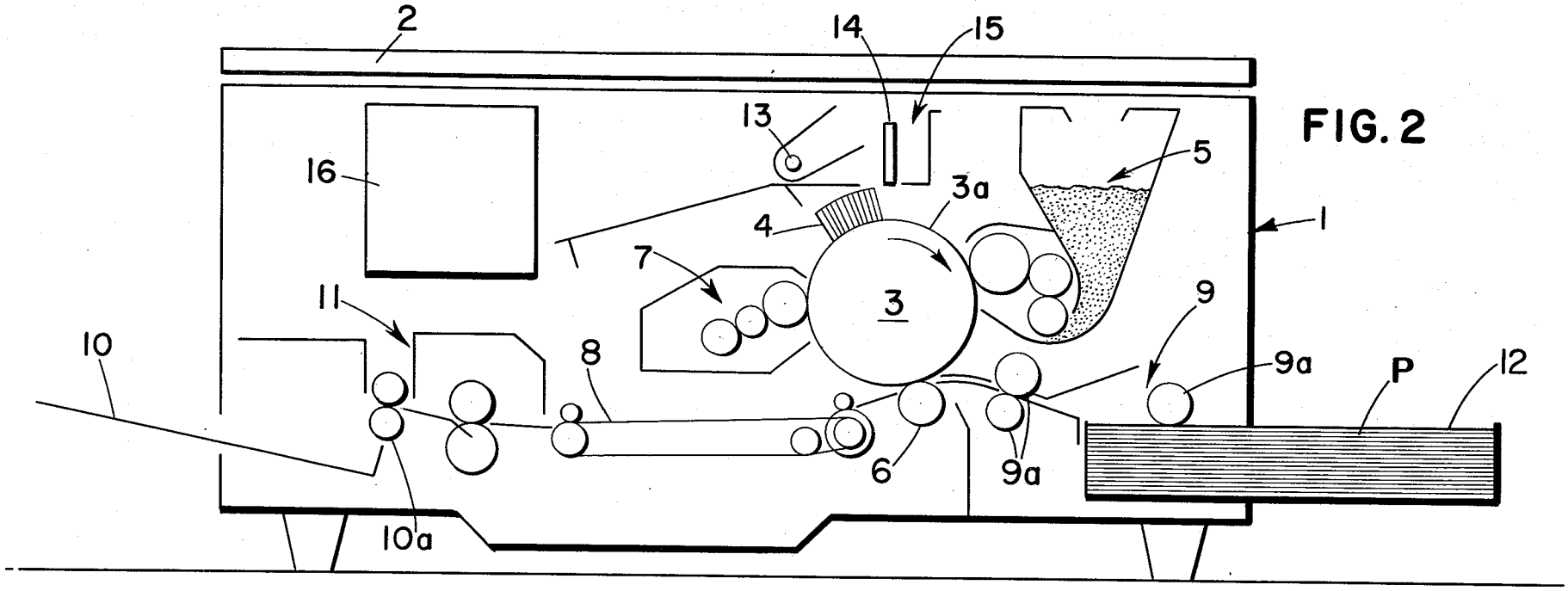
FIG. 2 is a schematic view of the electrostatic copying machine.

As shown in FIGS. 1 and 2, a reciprocating table 2 for holding the original to be copied is provided on the upper surface of the main body 1 of the electrostatic copying machine. A drum type photosensitive member 3, which is the electrostatic image bearing member is rotatably disposed near the central position of the main body 1. This photosensitive member 3 is constructed by coating the peripheral surface of an aluminum cylinder with a photosensitive film of zinc oxide. In order along the periphery of this photosensitive member 3, there is a charger unit 4, a developing apparatus 5, a transfer unit 6, and a cleaner unit 7 which contact the surface 3*a* of the photosensitive member. On the lower side of the main body 1, there is a longitudinal paper transporting path 8 which transports paper through the transfer unit 6. This paper transporting path 8 is provided with, from the starting end side, a paper supplying mechanism 9 consisting of paper supplying rollers 9*a*, the transfer unit 6, a fixing unit 11 and an exit roller 10*a*. At the starting end of this paper supplying path 8, a detachable paper supplying cassette 12 containing paper P is provided. At the exit end of the paper transporting path 8, a detachable receiving tray 10 is provided.

At the upper side of the main body 1, there is an exposure unit 15 which consists of an exposure lamp 13 and an optical fiber lens 14.

A drive motor 16 is provided at the upper side of the main body 1 to drive the above mechanisms, and at the same time, rotate the photosensitive member 3 in the direction of arrow (e.g., at a peripheral speed of 80 mm/s). The drive motor 16 gives a reciprocating motion to the original carrying table 2 in synchronism with the rotation of the photosensitive member 3.

A power switch 17 turns the power supply on and off and a control panel 19 is provided having a copy button 18, a button 20 for increasing the copy density, a button 21 for reducing the copy density, a quantity button 22 for setting the number of copies, a quantity indicator 23 for indicating the number of copies, and a status indicator 24 for indicating the condition of the copying machine. Frame 25 is mounted on the upper surface of the main unit 1 for installing the developing apparatus 5 as described below.

To make copies with the electrostatic copying machine, the original (not shown) is placed on the reciprocating table 2 with the power switch 17 turned ON, and the buttons on the control panel 19 are set to the desired condition. Then the reciprocating table 2 reciprocates, the photosensitive member 3 rotates, and other parts of the machine operate as further described below.

The original document placed on the reciprocating table 2 is illuminated by the exposure lamp 13, and the image of the original is focused on the surface 3*a* of the photosensitive member through the optical fiber lens 14. The charger unit 4 successively charges the photosensitive surface 3*a* of the photosensitive member 3, and the image passing through the optical fiber lens 14 is focused on the photosensitive surface 3*a* at the latter stage of the charging process to form a latent image. Next, the latent image is developed into a toner image by the developing apparatus 5, and carried to the transfer unit 6. At the same time, the paper supplying mechanism 9 successively picks up sheets of paper P one by one from the cassette 12, and the paper is transported through the paper transporting path 8 to the transfer section which is the contact surface between the transfer unit 6 and the photosensitive surface 3*a*. Thus, the toner image is transferred to paper P at this transfer section. The paper P then is moved through the paper transporting path 8 to the fixing unit 11 where it is fixed. After this, the paper P is sent to the receiving tray 10 to complete the copying operation. The photosensitive surface 3*a* is cleaned by the cleaner unit 7 and again returned to the charging process. The copying operation is completed by a series of the above copying processes.

In the above copying process, various apparatus contact the photosensitive surface 3*a* but this surface is not injured because the photosensitive surface 3*a* is formed by a photosensitive film of zinc oxide having excellent mechanical strength.

Figure 3:
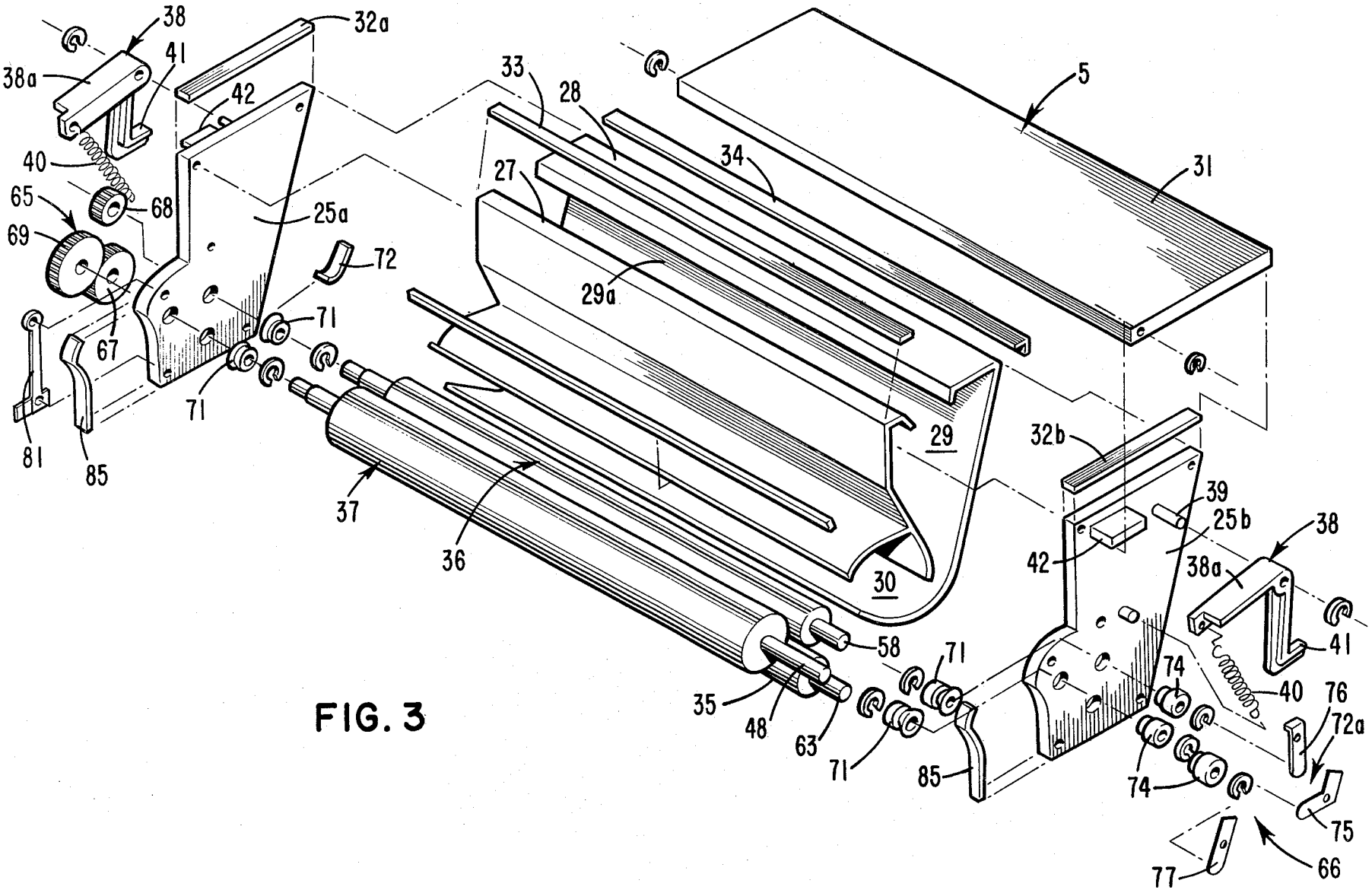
FIG. 3 is an exploded perspective view of the developing apparatus of the present invention.

FIG. 3 shows the construction of the developing apparatus 5 of the electrostatic copying machine of the present invention constructed as stated above. As shown, a front wall 27 and a rear wall 28 made of aluminum are positioned between a pair of side frames 25*a* and 25*b* (made of plastic material) which form the main body 26 of the developing apparatus 5. A toner supply container 29 is located between the front wall 27 and the rear wall 28, and a roller chamber 30 is located at the lower side of the front wall 27. The toner supply container 29 contains toner T composed of carbon and resin having a particle diameter of about 10 μm. On the upper part of frames 25*a* and 25*b*, one edge of a cover 31 is hinged in such a manner that the toner replenishing inlet 29*a* of the toner supply container 29 can be opened or closed freely. On the upper edge of the side frames 25*a* and 25*b*, magnetic plates 32*a* and 32*b* attract and fix the cover 31 when it is closed, and at the same time, these magnetic plates serve to seal the toner replenishing inlet 29*a*. On the upper edge of the front and rear walls 27 and 28, sealing plates 33 and 34 made of urethane seal the toner replenishing inlet 29*a* when the cover 31 is closed.

In the roller chamber 30 of the main body 26, three rotating and lateral rollers (a first brush roller 35, a second brush roller 36, and a developing fur brush roller 37 which is the developing roller) are provided. These rollers form the transporting system of the toner T in the toner supply container 29. The details about the arrangement, material, and electric supply method of the first brush roller 35, the second brush roller 36, and the developing fur brush roller 37 are explained below.

Carrying handles 38 are attached to both sides of the main body of the developing apparatus 5. These handles 38 can be freely turned by placing the middle position of the nearly L-shaped levers 38*a* over supporting shafts 39 on the side frames 25*a* and 25*b*. Springs 40 are attached to one end of the levers 38*a* to constantly keep them pulled downward. Projections 41 are used for positioning and stoppers 42 restrict the upward turning of the levers 38*a*. The developing apparatus 5 can be carried by lifting the upper side of the levers 38*a*.

Figure 4:
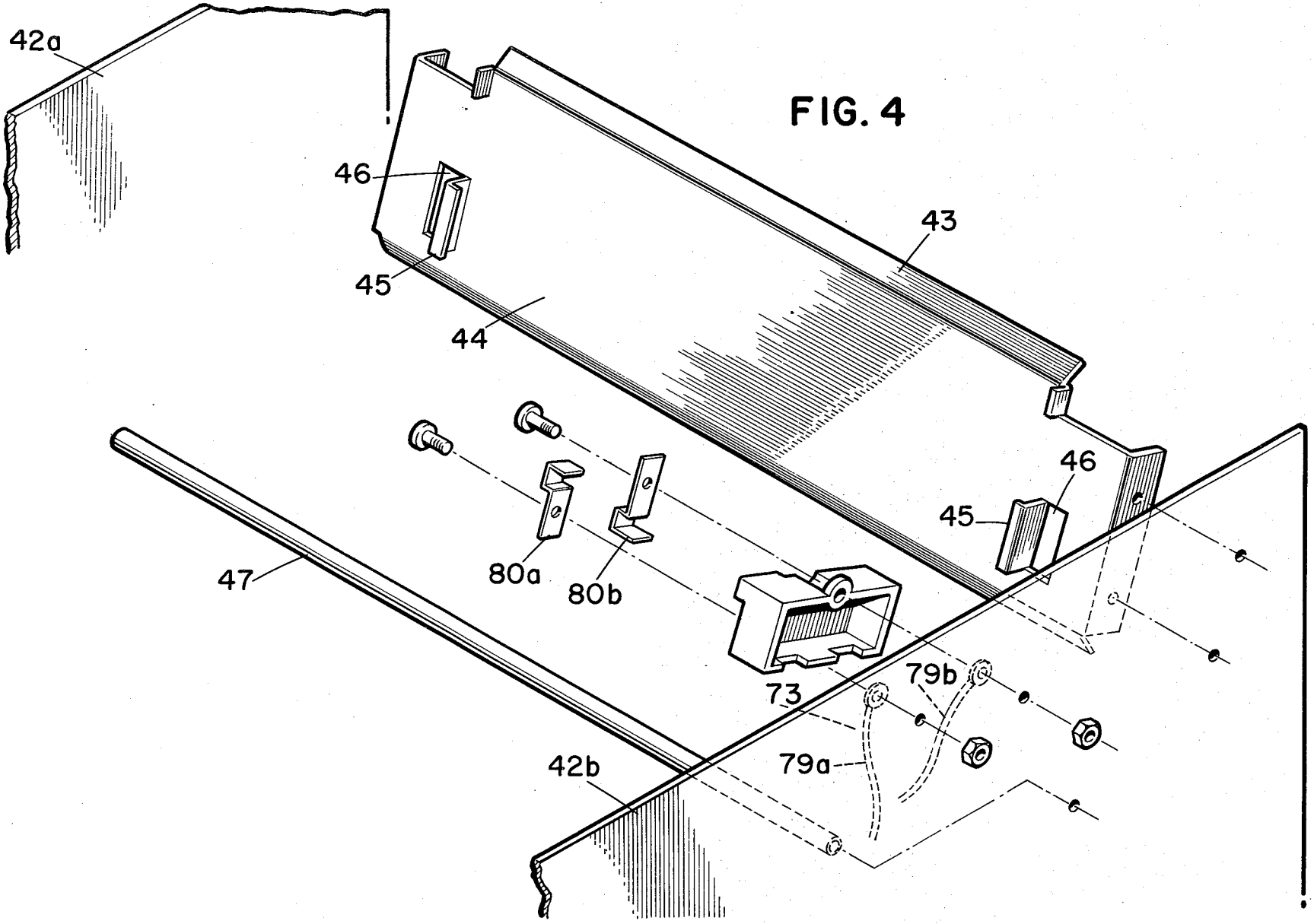
FIG. 4 is an exploded perspective view of the main body section which supports the developing apparatus.

The construction of the main body 1 which supports the developing apparatus 5 is shown in FIG. 4. A guide plate 43 is installed between a pair of side plates 42*a* and 42*b* 43*a* in an oblique direction. One side of the guide plate 43 forms a container support portion 44 which is connected with the installation frame 25 (FIG. 1) and which faces the photosensitive surface 3*a* of the photosensitive member 3. A pair of guides 45 are positioned near the ends of the guide plate 43. These guides 45 are made by cutting the plate according to the width of the main body 26 of the developing apparatus. Holes 46 correspond to the engaging projections 41 of the handles 38. A positioning stay 47 is provided at the lower part of the container support portion 44. The developing apparatus 5 is positioned by the guide plate 43 in the lateral direction by the guides 45 and in addition, the bottom side is positioned by the stay 47. Furthermore, the developing apparatus 5 is completely locked when the engaging projections 41 of the handles 38 are fitted into the engaging holes 46. The developing apparatus 5 is positioned where it makes contact with the photosensitive member 3 as shown in FIGS. 5 and 6. When removing the developing apparatus 5 from the main body 1, it is first released by lifting the levers 38*a* and then it is lifted out of the main body 1.

The arrangement of the first brush roller 35, the second brush roller 36 and the developing fur brush roller 37 is as follows. The first brush roller 35 is located at the bottom side in the roller chamber 30, and a part of its peripheral surface contacts the inside of the toner supply container 29 through a toner outlet 29*b*. The second brush roller 36 is positioned above the first brush roller 35 in such a way that their peripheral surfaces make contact with each other, and the developing fur brush roller 37 is arranged so as to make contact with the second brush roller 36 in the same way. By this arrangement of the rollers 35, 36, and 37, the peripheral surface of the developing fur brush roller 37 is kept in contact with the photosensitive surface 3*a* of the photosensitive member 3 when the developing apparatus 5 is installed.

Figure 7:
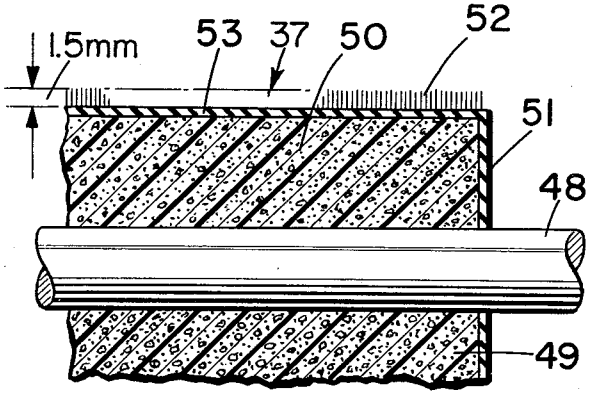
FIG. 7 is a partial sectional view of the developing roller.

The developing fur brush roller 37 is constructed as shown in FIG. 7. An aluminum shaft 48, which is the core metal, is wrapped with polyurethane foam 50 (e.g., EMM polyurethane known as MTP Kasei) 50 to form a soft cylindrical core 49. The EMM ployurethane foam 50 has a hardness of 23±5 kg (indication by JIS K-6401 Test Method) and a rebound elasticity of less than 45%. The circumferential surface and the side surfaces of this EMM polyurethane foam 50 are continuously coated with conductive bonding agents 51 to form a seamless conductive bonding agent layer 53 over the EMM polyurethane foam 50. In this way, the shaft 48 and the conductive bonding agent layer 53 are electrically conductive for supplying a bias voltage. The conductive bonding agent 51 is made of styrene-butadiene rubber composed of, e.g., 25% by weight of Tacprene (trade name of Asahi Kasei), 50% by weight of xylene resin, and 25% by weight of carbon XC-72 (trade name: Cabot, Tokyo Zairyo) which are diluted with toluene and then kneaded for about 2 hours in a ball mill. The conductive bonding agent 51 has the property that the rubber agent contracts with the evaporation of toluene, but by controlling the coating thickness, the contraction can be held small enough to present no problem in practical use.

The fur 52 is flocked on the outside of the conductive bonding agent layer 53 which is the peripheral surface of the core 49 to form a soft-type developing fur brush roller 37 having a diameter of, e.g., 30 mm. The fur 52 consists of abration resistant special rayon (fiber length 1.5 mm, diameter 1.5 denier, electric resistance $10^8\Omega$-$10^9\Omega$cm) which has been treated for electric conductivity. The electrostatic flocking method is used for sticking the rayon fiber.

The electrostatic flocking method is explained by FIG. 10. Part 49 is the core of the developing fur brush roller 37 which is preliminarily covered with the conductive bonding agent layer 53, and this core 49 is placed opposite an electrode plate 54 at a certain distance. An electric circuit is formed by connecting the shaft 48 of the core 49 and the electrode plate 54 with a DC power source 55. Part 56 is a ground terminal, and the core 49 is rotated at a revolution speed of 6 rpm by a drive mechanism (not shown). In this case, the interpole distance is set to 70 mm.

The fur is placed on the electrode plate 54, and by switching ON the DC power source 55 after rotating the core 49, a voltage of 30 kV is supplied across the core 49 and the electrode plate 54 from the DC power source 55. By this method, the fur 52 is uniformly fixed over the conductive agent bonding layer 53 in an erected condition through the interpole distance. After 10 seconds, the entire peripheral area of the core 49 is completely covered with the fur 52. Thus, flocking forms fur having a stable electric resistance of the given value; the most effective flocking is performed according to each set value. Therefore, to obtain the developing fur brush roller 37 having all the necessary properties, it is best to electrostatically flock special rayon which is treated for electric conductivity.

Figure 8:
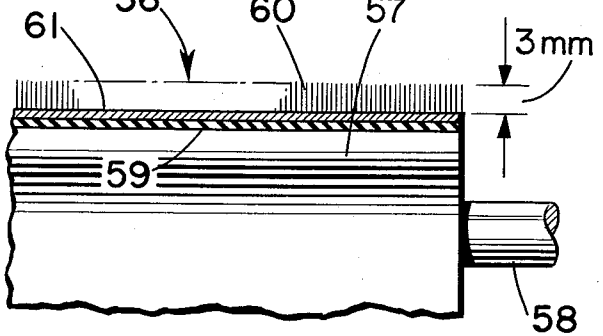
FIG. 8 is a partial sectional view showing the second brush roller.

The second brush roller 36 is constructed as shown in FIG. 8. The peripheral surface of a cylindrical core 57 made of aluminum material together with a shaft 58 is covered with a cloth 61 which is woven in a cylindrical form. The inside of this cloth 61 is provided with a conductive bonding agent layer 59 having the same property as used in the developing fur brush roller 37. The outside of this conductive bonding agent layer 59 is provided with a fur 60 consisting of seamless teflon fiber with a fiber length of 3 mm made of etyrene tetrafluoride material to form a hard-type brush roller 36 with a diameter of 20 mm. More particularly, the fur 60 is formed by raising the fiber of the peripheral surface of the cloth 61 which covers the peripheral surface of the core 57.

Figure 9:
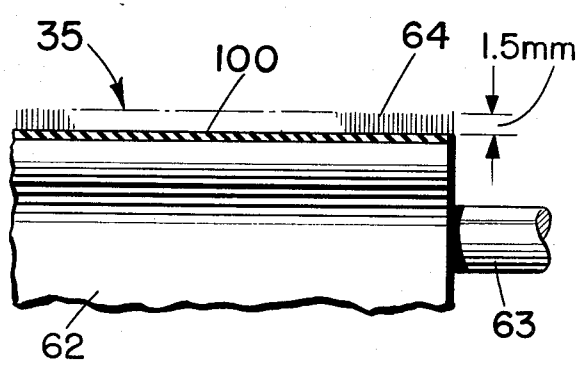
FIG. 9 is a partial sectional view showing the first brush roller.

The first brush roller 35 is constructed as shown in FIG. 9. The peripheral surface of a cylindrical core 62 and shaft 63 made of aluminum is provided with a conductive bonding agent layer 100. The outside of this conductive bonding agent layer 100 is provided with a fur 64 having the same property as used in the developing fur brush roller 37. This fur is flocked by the generally known electrostatic flocking method to form a hard-type brush roller 35 having a diameter of 20 mm.

Each of the rollers 35, 36, and 37 constructed in this way is arranged in the roller chamber 30 as stated above, and surplus toner recovery chambers 82*a*, 82*b*, and 82*c* are formed at the side gap along the rotating direction of the rollers 35, 36, and 37 (see FIG. 5). The shafts 48, 58, and 63 of these rollers are supported by the side frames 25*a* and 25*b* in a freely rotatable position through an oil seal 71 and a bearing 74. A drive system 65 and a bias voltage supply system 66 are connected to the rollers.

Each of the rollers 35, 36, and 37 is set as shown in FIGS. 11 and 12. FIG. 11 shows the contact condition between the photosensitive member 3 and the developing fur brush roller 37 and FIG. 12 shows the contact condition between the first brush roller 35 and the second brush roller 36. As illustrated, the photosensitive surface 3*a* projects 1 mm into the fur 52 of the developing fur brush roller 37 so as to increase the contact area. The distance between the first brush roller 35 and the second brush roller 36 is kept at 1 mm.

An explanation of the drive system 65 will now be given. As shown in FIGS. 3 and 6, the drive system consists of gears 67, 68, and 69 which are provided at one end of the rollers 35, 36, and 37; the gear 67 meshes with the gear 68 and the gear 68 meshes with the gear 69. When the developing apparatus 5 is installed the gear 69 meshes with a drive gear 70 on the main body 1. Thus, the drive force is successively transmitted through the gears 70, 69, 68, and 67 to drive the rollers 35, 36, and 37. The gear ratio between the gears 67, 68, and 69 is 12:7:17; and the ratio between the peripheral speeds of the first brush roller 35, the second brush roller 36, and the developing fur brush roller 37 is about 19:32:20 according to the following relations.

$$V_1=(0.2 \text{ to } 1.0)\times V_2=(1.1 \text{ to } 2.0)\times V_3$$

where, $V_1$ is the peripheral speed of the first brush roller 35, $V_2$ is the peripheral speed of the second brush roller 36, and $V_3$ is the peripheral speed of the developing fur brush roller 37.

By the above arrangement of the drive system 65, the first brush roller 35 is rotated clockwise by the drive gear 70, the second brush roller 36 is rotated counterclockwise and the developing fur brush roller 37 is rotated clockwise. The rollers 35, 36, and 37 which slidably contact each other are caused to rotate in the opposite directions which raises the fur 52, 59, and 64 and effectively supplies the proper amount of toner from the toner supply container 29 to the photosensitive member surface 3*a*.

The bearing section of the rollers 35, 36, and 37 is provided with a sealing urethane 72 to prevent leaks of the toner T. A scraper 83 slidably contacts the peripheral surface of the first brush roller 35 to control the amount of the toner T which is carried by the first brush roller 35 (see FIG. 5).

The bias voltage supplying system 66 is shown in FIG. 3. It is constructed of an electric receiving part 72*a* provided on the side of the main body of the developing apparatus 5 and an electric supplying part 73 provided on the main body 1 of the copying machine shown in FIG. 4.

As shown in FIG. 3, the electric receiving part 72*a* is constructed of elastic blades 75, 76, and 77 which are screwed on the outside surface of a side frame 25*b* and contact the end surfaces of rotating shafts of rollers 35, 36, and 37 on their respective free ends. Namely, the free end of the blade 75 contacts the end of the rotating shaft of the first brush roller 35, the free end of the blade 76 contacts the end of the rotating shaft of the second brush roller 36 and the blade 77 contacts the end of the rotating shaft of the developing fur brush roller 37. A block 78 is screwed on the inside surface of a side frame 42*b* corresponding to the side frame 25*b*. Lead wires 79*a* and 79*b* are connected from this block 78 to a medium voltage transformer (not shown). Two blades 80*a* and 80*b* are connected to the connecting ends of above lead wires 79*a* and 79*b*.

Upon mounting the developing apparatus 5, the blade 75 of above electric receiving part 72*a* and the blade 80*a* make contact and the blade 77 and the blade 80*b* make contact. The power supply source, the first brush roller 35 and the developing fur brush roller 37 form a circuit which carries a current to each roller 35 and 37. In particular, a DC (+250 V) bias voltage is applied to the first brush roller 35 and a DC (−100 V) bias voltage is applied to the developing fur brush roller 37 (see FIG. 13). Also, the blade 76, which contacts the inside surface of the side frame 42*b*, is grounded. The blade 81 contacts stay 47 shown in FIG. 4 and is grounded through casings 27 and 28 and the stay 47.

The side frames 25*a* and 25*b* are sealed by urethane foam 85 to prevent toner T from scattering, which occurs near the contacting part of the developing fur brush roller 37 and the photosensitive member 3.

Referring now to FIGS. 5 and 13, the operation of the developing apparatus 5 will be described. A bias voltage is supplied to the first brush roller 35 and the developing fur brush roller 37; a DC (+250 V) bias voltage 88 is applied to the fur 64 of the first brush roller 35; a (DC −100 V) bias voltage 87 to the fur 52 of the developing fur brush roller 37; and the second brush roller 36 is grounded. The toner T in the toner supply container 29 is transported by the first brush roller 35. The toner T adheres to the fur 64 of the first brush roller 35 and is limited to a proper amount by the scraper 83. At this time, the toner T is positively charged by frictional electricity due to the slidable contact of the scraper 83 and the fur 64. Next, the toner T2 is transported from the first brush roller 35 to the second brush roller 36 due to the potential gradient provided by ground voltage 89 and bias voltage 88.

All particles of toner T2 are not conductive at this stage and some of the toner T remains substantially neutral when it is transported to the second brush roller 36. Since every toner particle does not contact the fur 64 on the first brush roller 35 sufficiently, especially the toner particles outside the toner layer which adheres to the fur 64, it is difficult to charge all the toner particles. However, since the second brush roller 36 has the fur 60 formed with ethylene tetrafluoride material, it is negatively charged due to rotational friction with the first brush roller 35. For this reason, in transporting toner T and toner T2, they are charged in opposite polarity.

At the next stage, the fur 64 of the first brush roller 35 and the fur 60 of the second brush roller 36 bite each other and all toner particles are positively charged due to frictional electicity, and no unstable toner particles are present. Toner T and toner T2 are positively charged by the second brush roller 36 to form positively charged toner T3. This toner T3 is transferred to the second brush roller 36 by mechanical and electrostatic attraction and is transported to the developing fur brush roller 37. The toner T3 is supplied to the surface 3*a* of photosensitive member 3. On the surface 3*a* of photosensitive member 3, an electrostatic latent image of negative polarity is formed and toner 3 adheres electrostatically to this negative potential image.

As described before, the first brush roller 35, the second brush roller 36, and the developing fur brush roller 37 rotate in a manner which raises their respective furs 52, 60, 64. Accordingly, the fur does not droop during operation, and stable toner can always be supplied to the photosensitive member 3. Further, the peripheral speed difference of each roller 35, 36, and 37 can be increased to adjust the charging of the toner by frictional electricity.

By experimentation, it has been found that the furs 52, 60, and 64 droop when the peripheral speed of each roller 35, 36, and 37 is too fast and the furs 52, 60, and 64 are not raised when the speed is too low. As a result, it has been found that a satisfactory result can be obtained by setting the peripheral speed of each roller 35, 36, and 37 as follows:

$$V_1=(0.2\text{-}1.0)\times V_3$$

$$V_2=(1.1\text{-}2.0)\times V_3$$

where $V_1$: peripheral speed of 1st brush roller 35

$V_2$: peripheral speed of 2nd brush roller 36

$V_3$: peripheral speed of developing fur brush roller 37

Further, experimental data has been obtained at above the peripheral speed ratio. At this ratio, toner does not melt upon increasing or decreasing toner supply as a result of frictional heat, which is one of the unstable factors in supplying toner.

Moreover, according to experiment, a satisfactory result has been obtained when the fur length of the fur 52 on the developing fur brush roller 37 is within the range of 1 mm to 3 mm. At this length, the elastic force of the fur itself is not reduced, that is, the fur 52 is not drooped and the necessary amount of toner can be carried so that a clear copy of the image can be obtained.

Also, as the result of the above experiment, a sharp copy in image quality has been obtained by setting the electric resistance value of the fur 52 to $10^7\Omega cm-10^{10}\Omega cm$. In other words, when the resistance value of the fur 52 is lower than the above values, an excessive current flows through the photosensitive member 3 to break a latent image and reduce the sharpness of image quality. On the other hand, when the resistance value of the fur 52 is higher than the above values, the bias voltage will not function effectively causing abnormalities such as the non-image part becoming blackish.

When the amount of toner T3 supplied to the photosensitive surface 3*a* exceeds the limit, the excessive toner is stored in the fur 52 of the developing fur brush roller 37. When it exceeds the capacity of the developing fur brush roller 37, that is, when the toner T3 of the developing fur brush roller 37 becomes excessive, the excessive toner is recovered by the second brush roller 36. This is caused by the fact that the correlation between the attractive force of the negative voltage of the developing fur brush roller 37 and that applied to preserve the toner of the second brush roller 36 becomes unbalanced and the attractive force of the second brush roller 36 exceeds that of the developing fur brush roller 37. Thus, the excessive toner of the developing fur brush roller 37 is transferred electrostatically to the second brush roller 36 and is restored. In this case, the proper amount of toner T3 is preserved by the attractive force of the fur 52 of the developing fur brush roller 37.

The fur 52 of the second brush roller 36 is formed with tetraethylene flouride which has a large capacity for toner. For this reason, the toner storing capacity of the second brush roller 36 is very large so excessive toner can be recovered.

The toner recovery state in the above mechanism is determined by the tribo electricity of toner T, the bias of each roller 35, 36, and 37, the material of furs 52, 60, and 64 of rollers 35, 36, and 37, the conductivity of furs 52, 60, 64, etc. The combination described in the above embodiment is the most effective.

As shown in FIG. 5, the excessive toner which could not be recovered by the second brush roller 36 is recovered in the excessive toner recovery chamber 82*c*. When the recovered toner reaches a fixed quantity, it contacts the first brush roller 35 and is resupplied by the first brush roller 36. The excessive toner recovery chamber 82*a* is used to recover the excessive toner discharged from the second brush roller 36 and the developing fur brush roller 37. However, normally the excessive toner does not stay in the excessive toner recovery chamber 82*a*. The chamber 82*a* is wide to prevent clogging due to excessive toner which occurs when no bias is applied to the developing fur brush roller 37. The excessive toner recovery chamber 82*b* is used to recover the excessive toner discharged from the first brush roller 35. The chamber 82*b* is provided with gap 95. The gap 95 is extremely narrow to prevent the toner T from flowing backward into the excessive toner recovery chamber 82*b*.

According to the embodiment described above, it is unnecessary to use a high priced electromagnetic roller and toner. The invention provides a developing apparatus of simple construction, low in cost and suitable for use with a single component toner.

Furthermore, the developing fur brush roller 37 is constructed with a soft type of core 49 made of elastic EMM polyurethane foam 5. Therefore, the surface 3*a* of the photosensitive member 3 cannot be injured and the tolerances for the photosensitive member are not critical. Also, by setting the hardness of the polyurethane foam to 15–35 kg (indication of hardness in JIS K-6401), the developing area which contacts the photosensitive member 3 can effectively be widened and the developing time can be lengthened.

Finally, when the hardness of EMM polyurethane 50 is 15–35 kg, the gap tolerance between the photosensitive surface 3*a* and the roller 37 can be set more precisely because, even if the developing fur brush roller 37 and the photosensitive member 3 should come too near, the photosensitive member 3 is not injured.

In the embodiment described above, the first brush roller 35 is positioned below the second brush roller 36 and the developing fur brush roller 37. However, these rollers may be arranged as shown in FIG. 14. A toner supply container 90 is provided at the upper part, the first brush roller 91 is provided at the bottom of the container 90, the developing fur brush roller 92 is provided under the roller 91 and the second brush roller 93 is provided close to the rollers 91 and 92.

FIGS. 15 and 16 show another embodiment of the present invention. A pair of rollers 94 face the photosensitive member 3. The rollers 94 are made of electrically conductive material such as a metal. An endless developing fur belt 95 is passed round the rollers 94 and is kept in contact with the photosensitive surface 3*a* of the photosensitive member 3. The developing fur belt 95 is constructed as shown in FIG. 16. An endless belt member 96, which is the base, is made of electrically conductive rubber or electrically conductive cloth. The surface of this belt member 96 is continuously coated with a conductive bonding agent to form a conductive bonding agent layer 97. In this way the rollers 94 and the endless belt member 96 are made electrically conductive for supplying a bias voltage. Fur 98 is flocked on the outside of the conductive bonding agent layer 97 to form a soft-type developing fur belt 95. The fur 98 consists of abration resistant special rayon which has been treated for electric conductivity. The electrostatic flocking method is used for attaching the rayon fiber in the same manner as described above with reference FIG. 10.

Although illustrative embodiments of the present invention have been described in detail with reference to the accompanying drawings, it is to be understood that the invention is not limited to those precise embodiments. Various changes and modifications may be effected therein by one skilled in the art without departing from the scope or spirit of the invention.

We claim:

1. A developing apparatus for developing an electrostatic image on an electrostatic image bearing member, said apparatus comprising:

container means for storing toner; and developing means for transporting the toner from said container means and applying it to the electrostatic image on said electrostatic image bearing member, said developing means comprising a base made with elastic material and a fur formed on the peripheral surface of said base to contact the surface of said electrostatic image bearing member, said base comprising a roller-like core.

2. A developing apparatus for developing an electrostatic image on an electrostatic image bearing member, said apparatus comprising:

container means for storing toner; and a developing roller means for transporting the toner from said container means and applying it to the electrostatic image on said electrostatic image bearing member, said developing roller means comprising a core formed with elastic material, a conductive bonding layer provided on the peripheral surface of said core and a fur on the peripheral surface of said conductive bonding layer to contact the surface of said electrostatic image bearing member.

3. A developing apparatus for developing an electrostatic image on an electrostatic image bearing member, said apparatus comprising:

container means for storing toner; and developing roller means for transporting the toner from said container means and applying it to the electrostatic image on said electrostatic image bearing member, said developing roller means comprising a core formed with elastic material, a conductive layer on the peripheral surface of said core and a fur on the peripheral surface of said conductive layer, said fur having a length of 1 to 3 mm.

4. A developing apparatus as claimed in claim 3 wherein the electric resistance value of said fur is $10^7$ ohm cm to $10^{10}$ ohm cm.

5. A developing aparatus for developing an electrostatic image on an electrostatic image bearing member, said apparatus comprising:

container means for storing toner;

first brush roller means for transporting the toner from said container means by rotation, said first brush roller means comprising a core and a fur made of rayon material which is attached to the peripheral surface of said core;

developing roller means for contacting said electrostatic image bearing member and for applying the toner to the electrostatic image on said electrostatic image bearing member, said developing roller means comprising a core formed with elastic material and a fur made of rayon material which is attached to the peripheral surface of said core; and second brush roller means contacting the peripheral surfaces of said developing roller means and said first brush roller means for transporting the toner from said first brush roller means to said developing brush roller means and charging it by frictional engagement with the surfaces of said first brush roller means and said developing roller means, said second brush roller means comprising a core and a fur made of ethylene fluoride which is attached to the peripheral surface of said core.

6. A developing apparatus for developing an electrostatic image on an electrostatic image bearing member, the image bearing member comprising a rotating drum, said apparatus comprising:

container means for storing toner;

first brush roller means for transporting the toner from said container means by rotation;

second brush roller means contacting the peripheral surface of said first brush roller means and rotating in the opposite direction to the direction of rotation of said first brush roller means, said second brush roller means receiveing the toner from said first brush roller means; and brush-like developing roller means to contact said second brush roller means and said electrostatic image bearing member, said brush-like developing roller means comprising a core formed with elastic material and fur formed on the peripheral surface of said core, said developing roller means rotating in the opposite direction to the direction of rotation of said second brush roller means for receiving the toner from said second brush roller means and developing the electrostatic image formed on said electrostatic image bearing member.

7. A developing apparatus as claimed in claim 6 wherein the direction of rotation of said developing roller means is the same as that of said electrostatic image bearing member.

8. A developing apparatus as claimed in claim 6 wherein the peripheral speed ratios of said roller means are as follows:

$$V_1=(0.2 \text{ to } 1.0)\times V_3,$$

$$V_2=(1.1 \text{ to } 2.0)\times V_3,$$

where $V_1$: peripheral speed of said first brush roller means, $V_2$: peripheral speed of said second brush roller means, and $V_3$: peripheral speed of said developing roller means.

9. A developing apparatus for developing an electrostatic image on an electrostatic image bearing member, said apparatus comprising:

container means for storing toner;

first brush roller means for transporting the toner from said container means by rotation, said first brush roller means having a conductive fur on its surface where toner is transported;

second brush roller means contacting said first brush roller means, said second brush roller means having a conductive fur on its surface for receiving the toner transferred by said first brush roller means;

developing roller means contacting said second brush roller means and said electrostatic image bearing member, said developing roller means comprising a core formed with elastic material and a conductive fur on the peripheral surface of said core for receiving the toner transported by said second brush roller means and for developing an electrostatic image formed on said eletrostatic image bearing member; and bias means for supplying ground voltage to the fur on said second brush roller means and a voltage of positive polarity to the fur on said first brush roller means and a voltage of negative polarity to the fur on said developing roller means.

* * * * *